US006782232B2

(12) United States Patent
Hayami et al.

(10) Patent No.: US 6,782,232 B2
(45) Date of Patent: Aug. 24, 2004

(54) FIXING UNIT FOR AN IMAGE FORMING APPARATUS

(75) Inventors: Toshiki Hayami, Hachioji (JP); Hidetoshi Katayanagi, Hachioji (JP); Hajime Tanaka, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/386,646

(22) Filed: Mar. 12, 2003

(65) Prior Publication Data

US 2003/0180075 A1 Sep. 25, 2003

(30) Foreign Application Priority Data

Mar. 20, 2002 (JP) ..... 2002-078205
Mar. 26, 2002 (JP) ..... 2002-085388

(51) Int. Cl.[7] ..... G03G 15/20
(52) U.S. Cl. ..... 399/328; 399/330; 399/333
(58) Field of Search ..... 399/328, 330, 399/333

(56) References Cited

U.S. PATENT DOCUMENTS 4,149,797 A * 4/1979 Imperial ..... 399/333
4,814,819 A * 3/1989 Torino et al. ..... 399/333
4,842,944 A * 6/1989 Kuge et al. ..... 399/330
4,949,130 A * 8/1990 Torino ..... 399/333
5,243,393 A * 9/1993 Menjo ..... 399/333
5,319,427 A * 6/1994 Sakurai et al. ..... 399/333
5,327,202 A * 7/1994 Nami et al. ..... 399/333
5,364,697 A * 11/1994 Miyabayashi ..... 399/328
6,400,924 B1 * 6/2002 Watanabe ..... 399/333
6,424,815 B1 * 7/2002 Kawamoto et al. ..... 399/325
6,701,121 B2 * 3/2004 Nami et al. ..... 399/333

FOREIGN PATENT DOCUMENTS

JP 61-170769 * 8/1986 ..... G03G/15/20
JP 05-307334 * 11/1993 ..... G03G/15/20
JP 06-266257 * 9/1994 ..... G03G/15/20
JP 2001-228736 * 8/2001 ..... G03G/15/20

* cited by examiner

*Primary Examiner*—Fred Braun
(74) *Attorney, Agent, or Firm*—Muserlian, Lucas and Mercanti

(57) ABSTRACT

This invention relates to an image forming apparatus including a fixing unit which includes a heat section having a resilient body and a release layer that covers the resilient body, and a press section having a resilient body and a release layer that covers the resilient body and pressed by the heat section, and which heats and fixes a transfer medium at a nip portion as a press contact portion of the two sections. This fixing unit satisfies at least one of the following three conditions:

(a) the tensile strength of the resilient body of the heat section upon a lapse of an arbitrary use time is higher than its initial tensile strength or is not lower than the initial tensile strength by 0.5 MPa or more, (b) a relationship (H1−H0)−(h1−h0)≦0 is always satisfied where H0 is the initial surface hardness of the heat section, h0 is the initial surface hardness of the press section, and H1 and h1 are the surface hardnesses of the heat section and the press section, respectively, upon a lapse of the arbitrary use time, and (c) the modulus of impact resilience of the resilient layer of the heat section upon a lapse of the arbitrary use time is higher than its modulus of initial impact resilience before start of use, or is not lower than the modulus of initial impact resilience by 10% or more.

8 Claims, 7 Drawing Sheets

RESULTS OF EVALUATION FOR SEPARATION PERFORMANCE WITH MODULUS OF INITIAL IMPACT RESILIENCE OF 43%

| PRESET TEMPERATURES OF UPPER AND LOWER ROLLERS | SEPARATION PERFORMANCE |
|---|---|
| 150°C/130°C | × |
| 160°C/140°C | ○ |
| 170°C/150°C | ○ |
| 180°C/160°C | ○ |
| 190°C/170°C | ○ |
| 200°C/180°C | ○ |

RESULTS OF EVALUATION FOR SEPARATION PERFORMANCE WHEN MODULUS OF INITIAL IMPACT RESILIENCE HAS DECREASED TO 20% UPON A LAPSE OF 100 KP

| PRESET TEMPERATURES OF UPPER AND LOWER ROLLERS | SEPARATION PERFORMANCE |
|---|---|
| 150°C/130°C | × |
| 160°C/140°C | × |
| 170°C/150°C | × |
| 180°C/160°C | × |
| 190°C/170°C | ○ |
| 200°C/180°C | ○ |

FIG.7A

RESULTS OF EVALUATION FOR SEPARATION PERFORMANCE WITH MODULUS OF INITIAL IMPACT RESILIENCE OF 43%

| PRESET TEMPERATURES OF UPPER AND LOWER ROLLERS | SEPARATION PERFORMANCE |
|---|---|
| 150°C/130°C | × |
| 160°C/140°C | ○ |
| 170°C/150°C | ○ |
| 180°C/160°C | ○ |
| 190°C/170°C | ○ |
| 200°C/180°C | ○ |

FIG.7B

RESULTS OF EVALUATION FOR SEPARATION PERFORMANCE WHEN MODULUS OF INITIAL IMPACT RESILIENCE HAS DECREASED TO 20% UPON A LAPSE OF 100 KP

| PRESET TEMPERATURES OF UPPER AND LOWER ROLLERS | SEPARATION PERFORMANCE |
|---|---|
| 150°C/130°C | × |
| 160°C/140°C | × |
| 170°C/150°C | × |
| 180°C/160°C | × |
| 190°C/170°C | ○ |
| 200°C/180°C | ○ |

FIXING UNIT FOR AN IMAGE FORMING APPARATUS

BACKGROUND OF THE INVENTION

1. Field of the Invention

The present invention relates to an image forming apparatus having a fixing unit which fixes a toner image onto a transfer medium in accordance with a heat roller scheme that uses a heat roller and press roller.

2. Description of the Prior Art

Conventionally, in an image forming apparatus such as a copying machine, a printer, or a facsimile apparatus, a fixing unit which heats and fixes a recording medium (to be referred to as a transfer medium hereinafter) for carrying toner made of a heat-melting resin or the like often employs a heat roller scheme.

The heat roller type fixing unit is formed of a heat roller having a heat generating source such as a halogen heater in it, and a press roller pressed against it. A recording medium (to be referred to as a transfer medium hereinafter) such as a paper sheet is passed through a nip portion as a press contact portion of the pair of rollers that are being rotated, so that toner which is made of a heat-melting resin or the like and carried by the transfer medium is heated and fixed.

Each of the heat roller and press roller undergoes heat and pressure repeatedly. Then, the tensile strength and/or modulus of impact resilience decreases due to heat deterioration of the resilient layer as one constituent element of each roller, and the surface hardness of each roller changes, to break the roller. Therefore, the roller must sometimes be changed before it reaches a predetermined roller service life.

The heat roller type fixing unit conveys a transfer medium while fixing a toner image on it by rotation of the heat roller. Accordingly, the transfer medium may sometimes twine around the heat roller due to fusion of the toner. To prepare for such a case, the fixing unit employs, e.g., a method with which a nip portion forms an upward projection (an upper heat roller 41 arcuately deforms at a hip portion T as shown in FIG. 1) so that the separation performance of the transfer medium improves, or a separation pawl method with which a pawl for transfer medium separation is forcibly pressed against the heat roller.

FIG. 1 is a view showing how the transfer medium is conveyed at the nip portion.

As shown in FIG. 1, the heat roller 41 and a press roller 42 are formed of cylindrical metal cores 413 and 423, annular resilient layers 412 and 413 made of heat resistant rubber baked on the metal cores 413 and 423, and release layers 411 and 412 that cover the resilient layers 412 and 422, respectively. The press contact portion of the two rollers 41 and 42 forms the nip portion T.

According to the method of separating a transfer medium P by employing the nip portion T that forms an upward projection, the surface hardness of the heat roller 41 is decreased to be smaller than that of the press roller 42 (an angle θ of the heat roller 41 and transfer medium P during separation increases). Thus, the heat roller 41 clamps and conveys the transfer medium P while being deformed by the press roller 42. The impact resilience force (restoration force) of the heat roller 41 at the moment the transfer medium P is released from the nip portion T works in the direction of an arrow R, and the transfer medium P is separated.

The heat roller and press roller are usually exchanged during periodic inspection or the like when a predetermined use (copy) amount (100,000 copies in this embodiment) is reached. The hardnesses of the heat resistant rubber members 412 and 422 as the resilient layers (to be also referred to as resilient bodies hereinafter) change before the periodic inspection due to heat deterioration caused by repeated thermal stress or the like, and the moduli of the impact resilience of the resilient layers 412 and 422 sometimes decrease. In this case, since the impact resilience is insufficient, the heat roller 41 loses its stable separation performance, and causes defective separation.

According to the separation pawl method, the pawl may damage the heat roller, and vertical lines may accordingly be formed in the image, leading to a degradation in image quality.

SUMMARY OF THE INVENTION

The present invention has been made to solve the problems described above, and has as its object to provide an image forming apparatus having a heat roller type fixing unit with an improved durability.

It is another object of the present invention to provide an image forming apparatus having a heat roller type fixing unit that exhibits a stable separation performance.

In order to achieve the above objects, according to the main aspect of the present invention, there is provided an image forming apparatus comprising a fixing unit which includes a heat section having a resilient body and a release layer that covers the resilient body, and a press section having a resilient body and a release layer that covers the resilient body and pressed by the heat section, and which heats and fixes a transfer medium at a nip portion as a press contact portion of the two sections, wherein at least one of the following three conditions is satisfied:

(a) a tensile strength of the resilient body of the heat section upon a lapse of an arbitrary use time is higher than an initial tensile strength thereof or is not lower than the initial tensile strength by not less than 0.5 MPa, (b) a relationship $(H1-H0)-(h1-h0)\leqq 0$ is always satisfied where H0 is the initial surface hardness of the heat section, h0 is the initial surface hardness of the press section, and H1 and h1 are the surface hardnesses of the heat section and the press section, respectively, upon a lapse of the arbitrary use time, and (c) a modulus of impact resilience of the resilient layer of the heat section upon a lapse of the arbitrary use time is higher than a modulus of initial impact resilience thereof before start of use, or is not lower than the modulus of initial impact resilience by not less than 10%.

The image forming apparatus according to the main aspect has the following subsidiary aspects.

(1) The initial tensile strength of the heat section is not less than 0.6 MPa.

(2) A temperature of the press section is set within such a temperature range that the tensile strength of the resilient body thereof does not decrease.

(3) SP<A and SP<B are always satisfied where SP is the surface pressure at the nip portion, A is the tensile strength of the resilient body of the heat section, and B is the tensile strength of the resilient body of the press section.

(4) A relationship between the initial surface hardness H0 of the heat section and the initial surface hardness h0 of the press section satisfies H0<h0.

(5) $40\% \leqq E0 \leqq 60\%$ is satisfied where E0 is the modulus of initial impact resilience of the resilient body of the heat section.

(6) The resilient body of the heat section uses such a member that the modulus of impact resilience thereof is always larger than that of the resilient layer of the press section.

(7) The heat section and the press section comprise a heat roller and press roller, respectively, and a diameter of the heat roller is larger than that of the press roller.

As is apparent from the above aspects, according to the present invention, heat resistant rubber, whose tensile strength does not decrease, or decreases only by a small amount, by the heat deterioration of the heat section and press section is used. Thus, surface breaking or separation from the metal core is eliminated, and the durability is improved.

Also, according to the present invention, a resilient member the modulus of impact resilience of which does not change easily by heat deterioration is used for each of the heat section and press section without changing the arrangement of the fixing unit. Thus, the separation performance of the transfer medium from the heat section can be improved.

The above and many other objects, features and advantages of the present invention will become manifest to those skilled in the art upon making reference to the following detailed description and accompanying drawings in which preferred embodiments incorporating the principle of the present invention are shown by way of illustrative examples.

BRIEF DESCRIPTION OF THE DRAWINGS

FIGS. 7A and 7B are tables showing the results of experiments for evaluating the separation performance which are obtained when the modulus of initial impact resilience and the modulus of impact resilience decrease, respectively.

DETAILED DESCRIPTION OF THE PREFERRED EMBODIMENTS

Several preferred embodiments of the present invention will be described with reference to the accompanying drawings. An image forming apparatus according to the present invention will be described first.

In the description of the embodiments of the present invention, the terms used in this specification do not limit the technical scope of the present invention.

Figure 2:
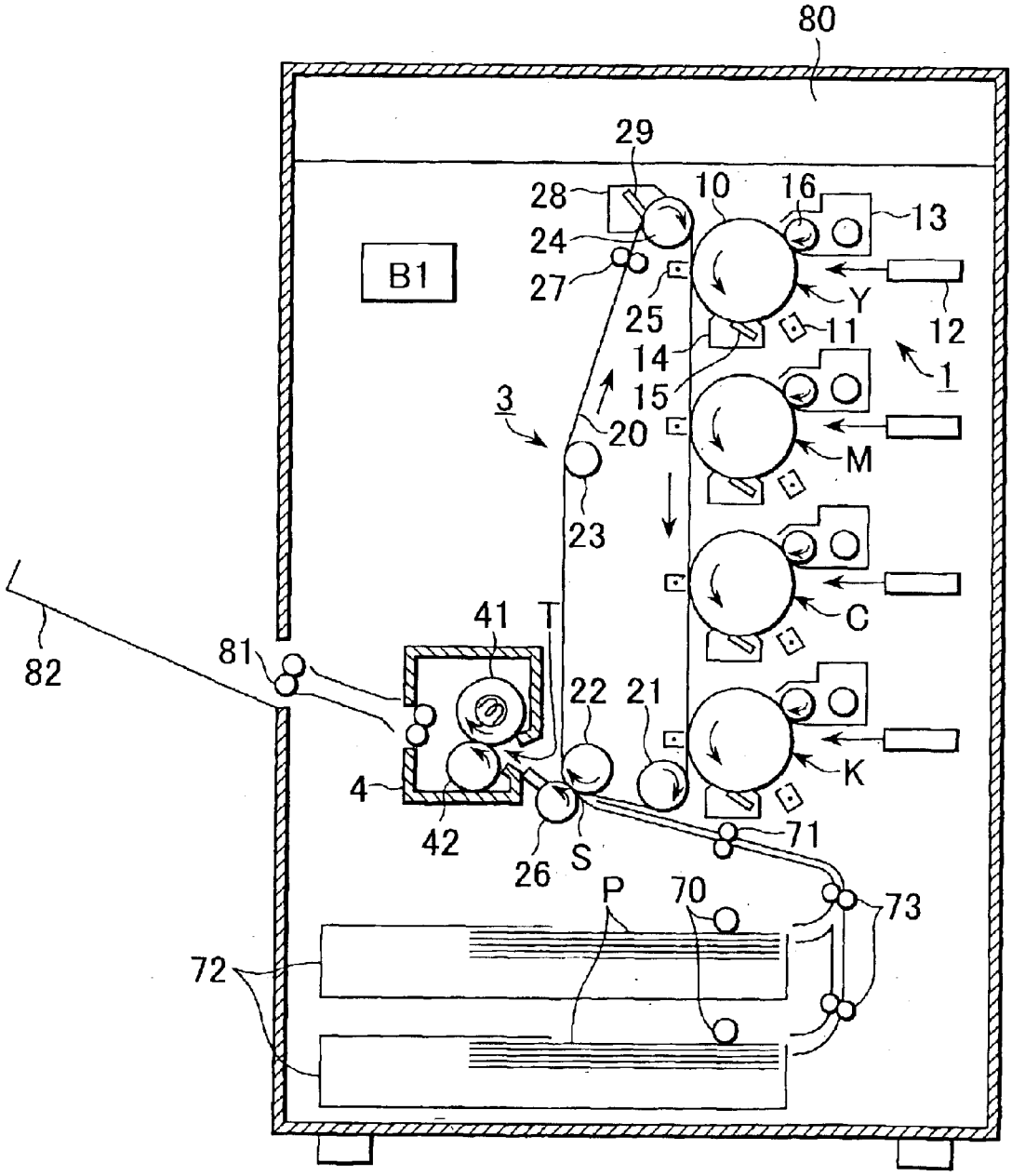
FIG. 2 is a schematic view showing an example of the overall arrangement of an image forming apparatus according to the present invention.

FIG. 2 is a schematic view showing an example of the overall arrangement of the image forming apparatus.

Referring to FIG. 2, reference numeral 10 denotes a photosensitive body; 11, a scorotron charging unit as a charging means; 12, a write unit as an image writing means; 13, a developing unit as a developing means; 14, a cleaning unit for cleaning the surface of the photosensitive body 10; 15, a cleaning blade; 16, a developing sleeve; and 20, an intermediate transfer belt as an image carrier. An image forming means 1 is constituted by the photosensitive body 10, scorotron charging unit 11, developing unit 13, cleaning unit 14, and the like. The mechanical arrangements of the image forming means 1 for respective colors are the same. Hence, in FIG. 2, only the elements of the arrangement for a Y (yellow) system have reference numerals. Reference numerals of the constituent elements for M (magenta), C (cyan), and K (black) systems are omitted.

The image forming means 1 for the respective colors are arranged in the order of Y, M, C, and K with respect to the traveling direction of the intermediate transfer belt 20. The respective photosensitive bodies 10 are in contact with the taut surface of the intermediate transfer belt 20 in point contact, and rotate in the same direction and the same linear velocity as the travel of the intermediate transfer belt 20.

The intermediate transfer belt 20 extends among a driving roller 21, a ground roller 22, a tension roller 23, discharging rollers 27, and a driven roller 24, and constitutes a belt unit 3 together with these rollers and the intermediate transfer belt 20, transfer units 25, a cleaning unit 28, and the like.

The intermediate transfer belt 20 is driven to travel by rotation of the driving roller 21 driven by a driving motor (not shown).

For example, the photosensitive body 10 is obtained by forming a conductive layer, an a-Si layer, or a photosensitive layer such as an organic photosensitive body (OPC) on the outer surface of a cylindrical metal substrate formed of an aluminum member. The photosensitive body 10 rotates counterclockwise as indicated by the arrow in FIG. 2, with its conductive layer being grounded.

An electrical signal corresponding to image data from a read unit 80 is converted into an optical signal by an image forming laser, and the resultant light is projected onto the photosensitive body 10 by the write unit 12.

The developing unit 13 maintains a predetermined gap with respect to the outer surface of the photosensitive body 10, and has the cylindrical developing sleeve 16 which is made of a nonmagnetic stainless steel or aluminum member and rotates in the same direction as the rotating direction of the photosensitive body 10 where it is closest to the photosensitive body 10.

The intermediate transfer belt 20 is an endless belt having a volume resistivity of $10^6\Omega\cdot$cm to $10^{12}\Omega\cdot$cm, which is a two-layered seamless belt obtained by coating, preferably with a fluorine coating having a thickness of 5 $\mu$m to 50 $\mu$m as a toner filming preventive layer, the outer surface of a semiconductive film substrate which has a thickness of 0.1 mm to 1.0 mm and is obtained by dispersing a conductive material in an engineering plastic such as modified polyimide, thermosetting polyimide, an ethylene tetrafluoroethylene copolymer, polyvinylidene fluoride, a nylon alloy, or the like. Other than this, as the substrate of the belt, a semiconductive rubber belt having a thickness of 0.5 mm to 2.0 mm and obtained by dispersing a conductive material in silicone rubber, urethane rubber, or the like can be used.

Reference numeral 25 denotes the transfer unit. A DC current having a polarity opposite to that of the toner is applied to the transfer unit 25, so that the toner image formed on the photosensitive body 10 is transferred onto the intermediate transfer belt 20. As the transfer unit 25 other than a corona discharging unit, a transfer roller can also be used.

Reference numeral 26 denotes a transfer roller that can be released from the ground roller 22. The transfer roller 26 transfers the toner image formed on the intermediate transfer belt 20 onto a transfer medium P again.

Reference numeral 28 denotes the cleaning unit. The cleaning unit 28 opposes the driven roller 24 through the intermediate transfer belt 20. After transferring the toner image onto the transfer medium P, the charges of the toner remaining on the intermediate transfer belt 20 are weakened by the discharging rollers 27 to which an AC voltage, superposed with a DC voltage having the same polarity as or the opposite polarity to that of the toner, is applied. Then, a cleaning blade 29 cleans the toner remaining on the surface of the intermediate transfer belt 20.

Reference numeral 4 denotes a fixing unit. The fixing unit 4 has a heat roller 41 as a heat section and a press roller 42 as a press section.

Reference numeral 70 denotes paper feed rollers; 71, timing rollers; 72, paper cassettes; and 73, convey rollers.

The fixing unit according to the present invention will be described with reference to FIGS. 3, 4A, 4B and 5.

Figure 3:
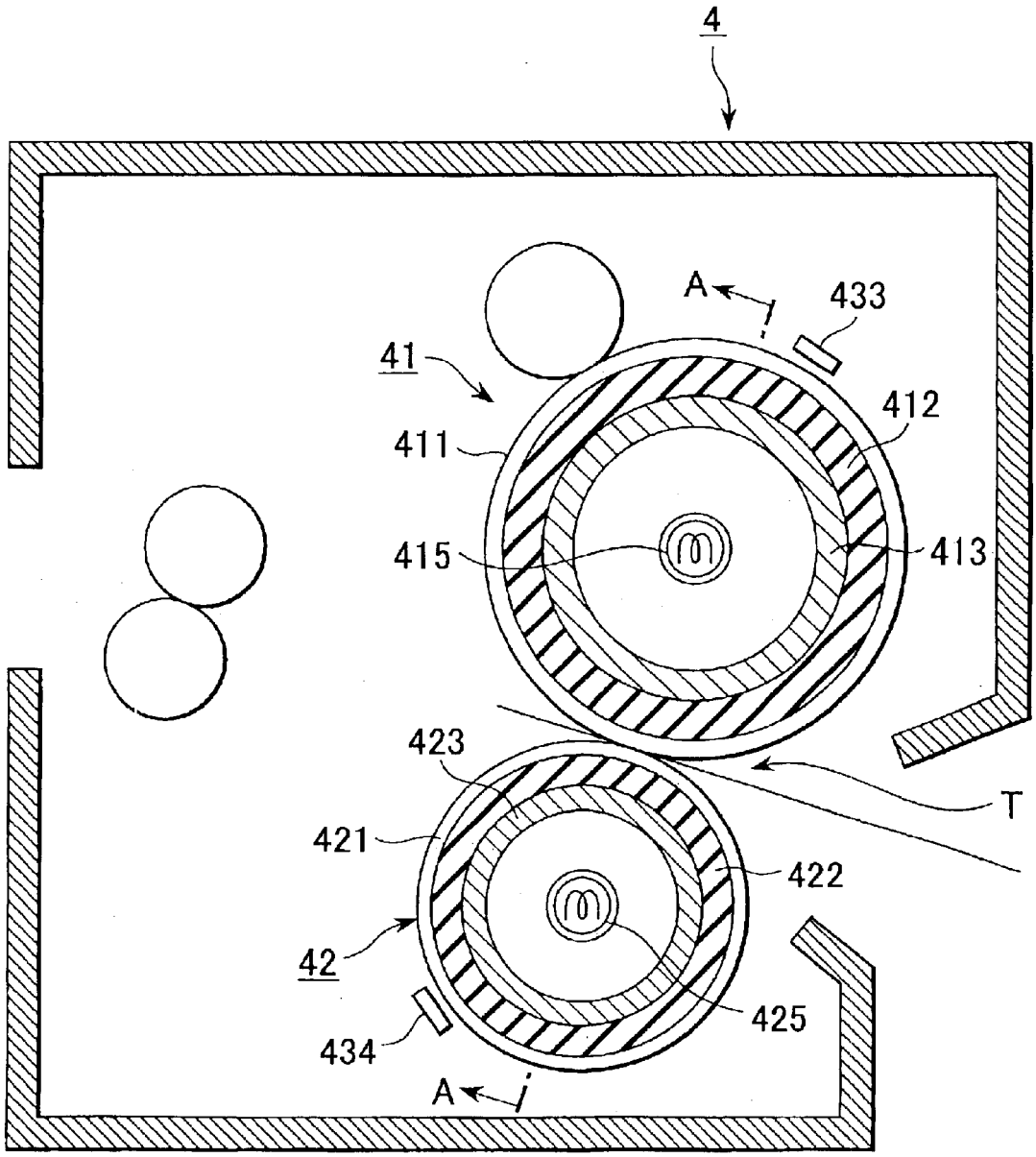
FIG. 3 is a schematic view showing the section of a heat roller type fixing unit.
Figure 4A:
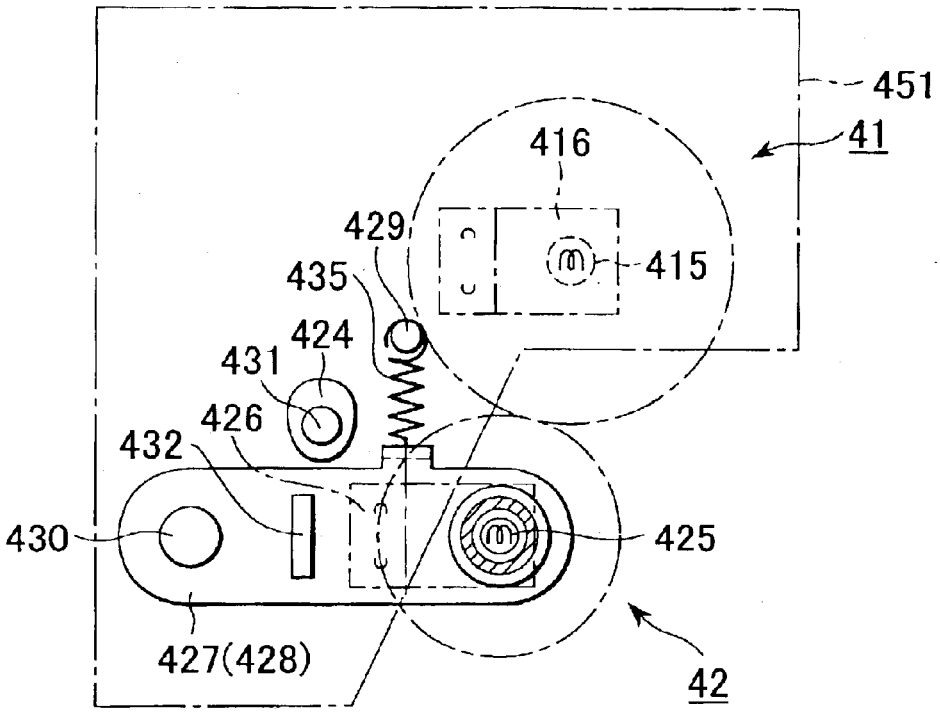
FIGS. 4A and 4B are schematic views each showing the pressing mechanism of a press roller.
Figure 4B:
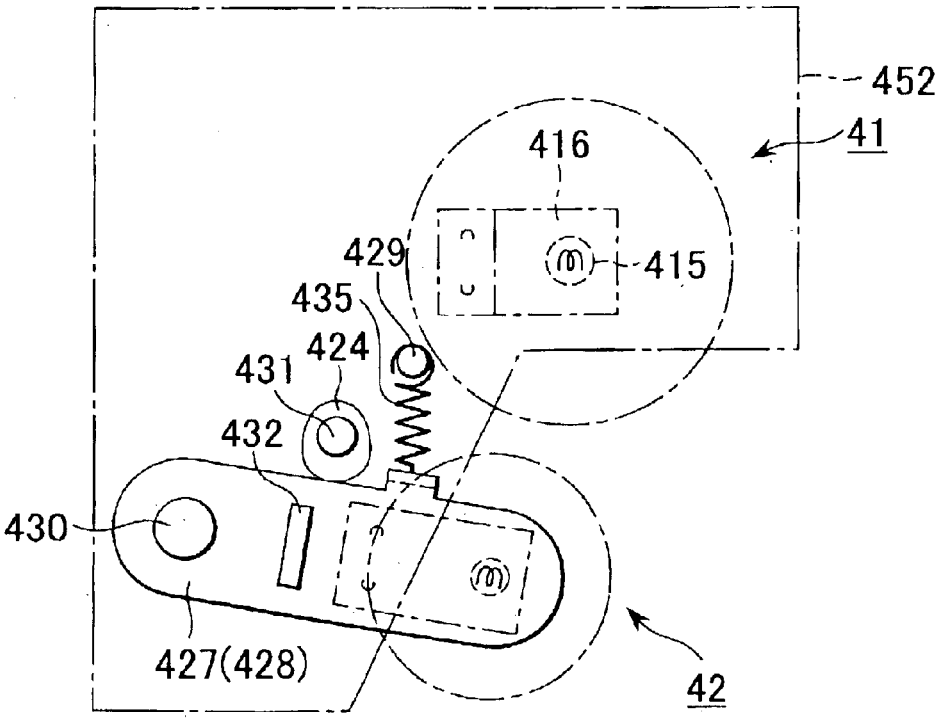

In the description concerning FIGS. 3, 4A and 4B, the obverse surface of the sheet of drawing corresponds to the front side, and its reverse surface corresponds to the rear side.

Referring to FIG. 3, in the heat roller 41 as the heat section, silicone-based heat resistant rubber 412 serving as a resilient layer (to be also referred to as a resilient member hereinafter) is baked on a cylindrical metal core (to be merely referred to as a metal core hereinafter) 413 molded from an aluminum pipe, and a release layer 411 is formed on the outer surface of the heat resistant rubber 412. The heat roller 41 is supported by a front plate 451 and rear plate 452 through heat insulation sleeves 417 (shown in FIG. 5) inserted in the two ends of the metal core 413. Reference numeral 415 denotes a heater. The heater 415 is disposed in the hollow portion of the heat roller 41, and its two ends are supported by support plates 416 (shown in FIGS. 4A, 4B and 5) attached to the front plate 451 and rear plate 452, respectively. Connectors (not shown) are inserted in the two terminals of the heater 415.

In the press roller 42 as the press section, silicone-based heat resistant rubber 422 serving as a resilient layer (to be also referred to as a resilient member hereinafter) is baked on a metal core 423 molded from an aluminum pipe, and a release layer 421 is formed on the outer surface of the heat resistant rubber 422. The press roller 42 is supported through heat insulation sleeves 429 fitted in support levers 427 and 428 shown in FIGS. 4A, 4B and 5. Reference numeral 425 denotes a heater. The heater 425 is disposed in the hollow portion of the press roller 42, and its two ends are supported by support plates 426 (shown in FIGS. 4A, 4B and 5) attached to the support levers 427 and 428. Connectors (not shown) are inserted in the two terminals of the heater 425.

Figure 1:
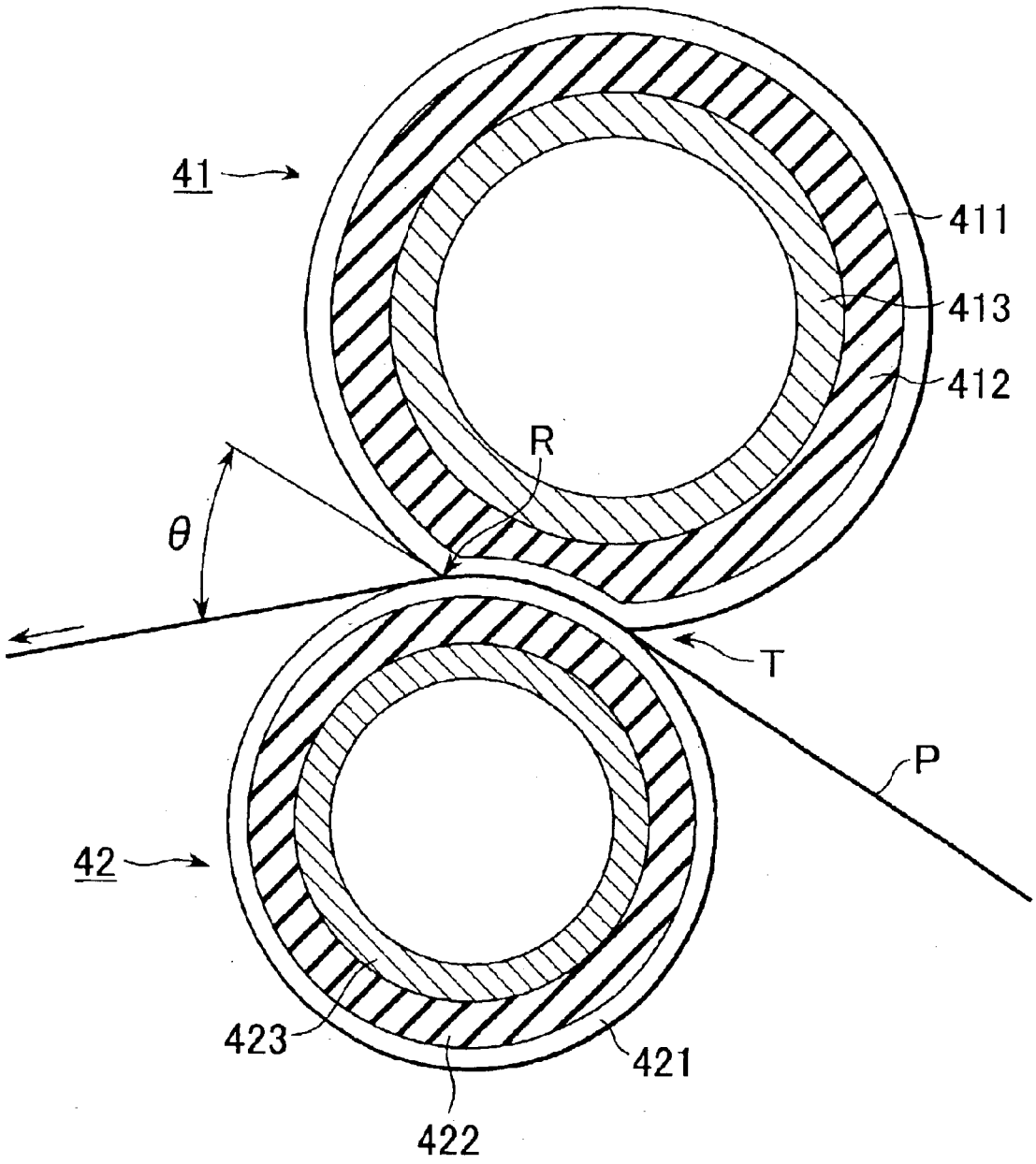
FIG. 1 is a sectional view showing how a transfer medium is conveyed at the nip portion of a fixing unit.

The press contact portion of the heat roller 41 and press roller 42 forms a nip portion T. The nip portion T forms an upward projection as shown in FIG. 1.

Reference numerals 433 and 434 denote temperature detection sensors for the heat roller 41 and press roller 42, respectively. Detection signals from the temperature detection sensors 433 and 434 are transmitted to a controller B1 (see FIG. 2), so that the respective rollers 41 and 42 are adjusted by thermostats (not shown) to maintain regulated preset temperatures.

Referring to FIGS. 4A and 4B, reference numerals 451 and 452 denote the front and rear plates of a frame that forms the skeleton structure of the fixing unit 4. The front and rear plates 451 and 452 support the heat roller 41, a support lever shaft 430, and a cam rotary shaft 431 through the heat insulation sleeves 417 and heat insulation sleeves 437 and 436 shown in FIG. 5. The support lever 427 (428) is reinforced by a stay 432 to be integral with it. Reference numerals 435 denote coil springs which cause the press roller 42 to abut against the heat roller 41 with a predetermined pressure through the support lever 427 (428). One end of each coil spring 435 is caught by the support lever 427 or 428, and the other end thereof is locked by a corresponding spring catch 429 provided to the front plate 451 or rear plate 452.

The press roller 42 is controlled to abut against the heat roller 41 at least while the transfer medium passes through the nip portion T.

Reference numerals 424 denote cams that release the press roller 42 from the heat roller 41 against the coil springs 435. The cams 424 are attached to the cam rotary shaft 431 with the same phase each at a position where its cam surface abuts against the support lever 427 (428), and rotate upon reception of rotation forces from power transmitting portions (not shown).

The support lever 427 (428) can pivot about the support lever shaft 430 as the fulcrum, is rotated counterclockwise by the corresponding coil spring 435, and swings the press roller 42 vertically with a phase of 180° with the corresponding cam 424, to cause the press roller 42 to abut against the heat roller 41 with a predetermined pressure.

Figure 5:
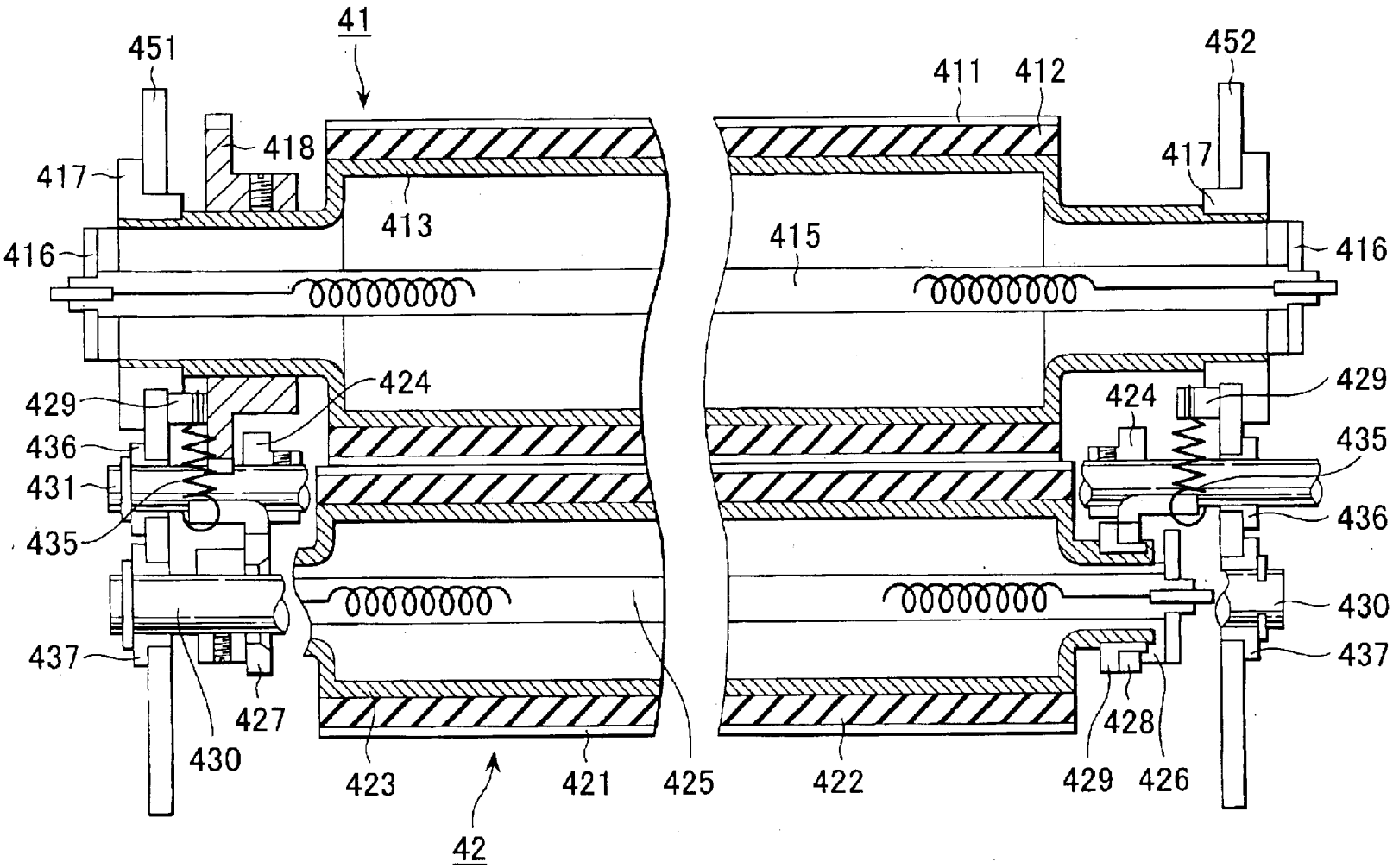
FIG. 5 is a sectional view (seen from arrows A of FIG. 3) of heat and press roller sections.

Referring to FIG. 5, in the heat roller 41, a rotation force is transmitted from a power supply (not shown) to a gear 418 fixed to one side of the metal core 413 through a gear train.

When the press roller 42 is pressed, it abuts against the heat roller 41 and is rotated by it. To release the pressure, each cam 424 pushes the support lever 427 (428) downward against the coil spring 435, so that the heat roller 41 and press roller 42 separate from each other.

The structures and mechanisms of the heat and press rollers have been described. The durability of the heat roller and press roller will now be described.

The heat roller and press roller are usually exchanged during periodic inspection or the like when a predetermined use (copy) amount (100,000 copies in this embodiment) is reached. Sometimes the surface of the roller may break or the heat insulation rubber and the metal core may separate from each other before the periodic inspection because of repeated thermal stress or the like. Then, a predetermined service life cannot be maintained.

The characteristic feature of the present invention resides in the following respect. That is, attention is turned to the tensile strength of the heat resistant rubber as the resilient bodies of the heat roller and press roller. A material that satisfies the conditions for improving the durability within the regulated preset temperature range is selected. The service life of each roller is thus prolonged, and troubles as described above can be avoided.

More specifically, according to the first embodiment, a material is used with which the tensile strength of the heat resistant rubber (resilient body) 412 of the heat roller 41 is 0.6 MPa or more at the start of heating (initial stage), and upon a lapse of an arbitrary heating (use) time, is always higher than the tensile strength at the start of heating, or is not lower than that by 0.5 MPa or more. The preset temperature of the press roller 42 is set within a temperature range with which the tensile strength of the heat resistant rubber 422 does not decrease, so that the durability of the rollers can be improved.

According to the second embodiment, the relationship between the heat roller and press roller is maintained to always satisfy SP<A and SP<B where SP (MPa) (megapascal) is the surface pressure at the nip portion T, A (MPa) is the tensile strength of the heat roller 41, and B (MPa) is the tensile strength of the press roller 42. In other words, the durability of the rollers can be improved by using heat resistant rubber that has a larger tensile strength than the surface pressure at the nip portion T.

The tensile strength in this case refers to the breaking strength. In the present invention, note that the tensile strength is measured in compliance with JIS K6251. If a load corresponding to this tensile strength is applied, the resilient body will break.

Figure 6:
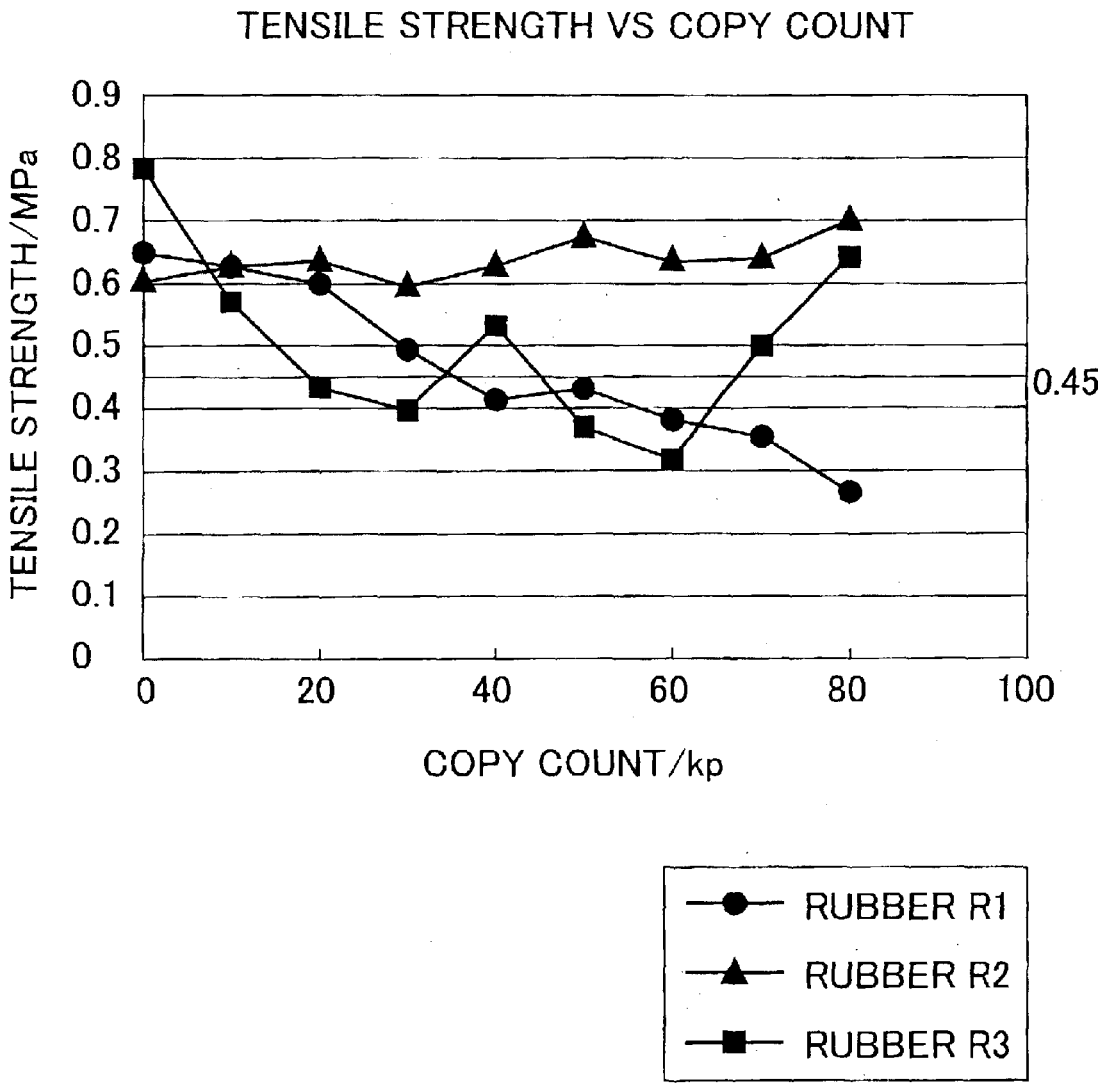
FIG. 6 is a graph showing the relationship between the tensile strengths of three types of heat resistant rubbers and the copy amounts.

FIG. 6 is a graph showing the relationship between the tensile strengths of three types of heat resistant rubbers (high-heat-conduction LTV (Low Temperature Vulcanized) silicone rubber) and copy amounts.

This graph shows values obtained by leaving each heat resistant rubber in a temperature atmosphere of 260° C. for a period of time corresponding to continuous 80 kp (80,000 copies) and measuring the tensile strength every predetermined period of time (copy amount).

A case will be studied wherein a nip surface pressure appropriate for fixing is set to 0.45 MPa. With some rubber, even when the initial tensile strength is high, it may decrease to be lower than 0.45 MPa as the copy amount increases, as with rubber types R1 and R3, or may maintain 0.60 MPa or more, as with rubber type R2. Therefore, when a heat member and press member made of, e.g., rubber type R2 with which the tensile strength does not decrease or decreases only by a small amount due to heat deterioration, are used, the roller can be avoided from breaking.

Durability tests performed by employing the heat resistant rubber (high-heat-conduction LTV silicone rubber) and temperature setting according to the above conditions will be performed.

The durability tests were performed with the fixing unit alone under the following preset conditions.

For the heat roller, the preset temperature was 200° C., and the initial tensile strength of the heat resistant rubber was 0.7 MPa (tensile strength test according to JIS K6251).

For the press roller, the preset temperature was 180° C., and the initial tensile strength of the heat resistant rubber was 0.7 MPa (tensile strength test according to JIS K6251).

The surface pressure of the nip portion was 0.38 MPa. Under the above conditions, no abnormalities were observed even when the copy amount reached 120,000 copies. The tensile strength of the heat resistant rubber did not decrease, but increased gradually up to 1.1 MPa.

With the same preset temperature (heat roller: 200° C., press roller: 180° C.) and the same surface pressure of the nip portion (0.38 MPa), when heat resistant rubber (with the initial tensile strength of 0.3 MPa; lower than the surface pressure of the nip portion) was employed, the roller broke when the copy amount reached 100 copies. In other words, early breaking may have occurred because the initial tensile strength was lower than the surface pressure of the nip portion.

With the same preset temperature (heat roller: 200° C., press roller: 180° C.) and the surface pressure of the nip portion of 0.45 MPa, when heat resistant rubber having an initial tensile strength of 0.6 MPa (note that the tensile strength of this heat resistant rubber can decrease to 0.45 MPa or less) was employed, the roller broke when the copy amount reached 6,000 to 7,000 copies. This may be due to the following reason. When the copy amount was 6,000 copies or less, the tensile strength had not decreased to 0.45 MPa or less. Roller breaking may have occurred when the tensile strength became 0.45 MPa or less.

Next, the separation performance of the transfer medium from the heat roller (to be merely referred to as separation performance hereinafter) used in the fixing unit of the present invention will be described.

An Asker-C hardness meter is employed for hardness measurement of the present invention, and a method according to JIS K6255 is employed for measurement of the modulus of impact resilience.

According to the third embodiment of the present invention, the separation performance can be improved by constantly maintaining H0<h0 where H0 is the surface hardness (to be merely referred to as hardness hereinafter) before heating of the heat roller 41 as the heat section and h0 is the surface hardness of the press roller 42 as the press section, and by always maintaining an inequality (H1−H0)−(h1−h0)≦0 where H1 and h1 are the surface hardness of the heat roller 41 each upon a lapse of arbitrary use (heating) time.

For example, when H0=78° and h0=86° change to H1=80° and h1=88°, the hardness difference of the heat roller and that of the press roller are 2° before heating and upon a lapse of an arbitrary use time, so that the nip shape (upper projection) does not change. When H0=78° and h0=86° change to H1=75° and h1=86°, the hardness difference of the heat roller before heating and upon a lapse of an arbitrary use time is 3°, indicating that the heat roller has become soft, while the hardness difference of the press roller is 0°, indicating no change. Therefore, the nip portion T projects more upwardly (in such a direction in which the angle θ of FIG. 1 increases). This is advantageous for separating the transfer medium from the heat roller 41. Both of the above two cases satisfy the above inequality. When, however, H0=78° and h0=86° change to H1=80° and h1=86°, the hardness difference of the heat roller before heating and upon a lapse of an arbitrary use time is 2°, indicating that the heat roller has become hard, while the hardness difference of the press roller is 0°, indicating no change. Therefore, the above inequality is not satisfied. The nip shape changes to form a downward projection. This is disadvantageous for separating the transfer medium from the heat roller 41.

As is understood from the above description, according to the above inequality, since the change amount of the hardness the press roller 42 is large when compared to that of the heat roller 41, the nip shape (upward projection) set before heating does not change in a direction which is disadvantageous regarding the separation performance (direction to form a downward projection).

When the diameter of the heat roller is set larger than that of the press roller, the transfer medium can separate from the heat roller 41 easily.

According to the fourth embodiment of the present invention, 40%≦E0≦60% is satisfied where E0 is the modulus of initial impact resilience of the heat resistant rubber 412 before heating, and the hardness of the heat roller 41 is always lower than that of the press roller 42. Then, the nip portion T can maintain its upward projecting shape, as shown in FIG. 1, and the separation performance can be improved.

According to the fifth embodiment of the present invention, the modulus E1 of impact resilience of the heat resistant rubber 412 and the modulus E2 of impact resilience of the heat resistant rubber 422 always maintain an inequality E2<E1. Then, the restoration force of the heat roller 41 at the moment the transfer medium P is released from the nip portion T becomes large, so that the separation performance can be improved.

According to the sixth embodiment of the present invention, a member is employed with which the modulus of impact resilience of the heat resistant rubber 412 upon a lapse of an arbitrary use time is higher than that before heating or is not lower than that by 10% or more. Then, the separation performance can be improved.

Regarding the fixing unit provided to the image forming apparatus of the present invention, a result will be described which is obtained by performing experiments with a heat roller and press roller made of silicone rubbers (high-heat-conduction LTV silicone rubbers) that satisfy the following preset conditions.

The linear velocities, nip shapes, and nip pressures of the heat roller and press roller were 220 mm/s, upward projections, and 0.4 MPa.

Concerning the heat roller, the preset temperature was 200° C., the modulus of impact resilience was 43% (measurement test according to JIS K6255), the Asker-C hardness of the heat resistant rubber was 60° (the thickness was 2 mm), the Asker-C surface hardness of the heat roller was 77°, and the diameter was 65 mm.

Concerning the press roller, the preset temperature was 180° C., the modulus of impact resilience was 20% (measurement test according to JIS K6255), the Asker-C hardness of the heat resistant rubber was 52° (the thickness was 2 mm), the Asker-C surface hardness of the press roller was 86°, and the diameter was 55 mm.

Experiments were performed under the above conditions. Even upon a lapse of time corresponding to 100 kp (100,000 copies), the separation performance exhibited no abnormalities.

FIGS. 7A and 7B are tables showing the results of experiments for evaluating the separation performance which are obtained when the modulus of impact resilience decreases.

FIG. 7A shows the results of evaluation for the separation performance which are obtained with a heat roller having a modulus of initial impact resilience of 43% before heating while changing the preset temperature. FIG. 7B shows the results of evaluation for the separation performance which are obtained with this heat roller the modulus of impact resilience of which has lowered to 20% after it is used for 100 kp.

Referring to FIG. 7A, with the heat roller having a modulus of initial impact resilience of 43% (not used yet, no heat deterioration), the separation performance shows an abnormality only after the temperatures of the heat (upper) and press (lower) rollers are decreased to 150° C. and 130° C., respectively. In contrast to this, referring to FIG. 7B, after the same rollers undergo heat deterioration and their moduli of impact resilience decrease to 20%, the separation performance shows an abnormality when the roller temperatures are 180° C. and 160° C. More specifically, when the moduli of impact resilience decrease due to heat deterioration caused by use for 100 kp, a region with a good separation performance (indicated by o) may narrow due to this decrease.

An image formation process will be described with reference to FIG. 2.

When image recording is started, a photosensitive body driving motor (not shown) is started simultaneously, and the photosensitive body 10 for a color signal Y is rotated counterclockwise as indicated by the arrow. At the same time, the scorotron charging unit 11 charges to start applying a potential to the photosensitive body 10.

After the potential is applied to the photosensitive body 10, the write unit 12 starts to write an image corresponding to Y image data on the photosensitive body 10, and an electrostatic latent image corresponding to the Y image of the document image is formed on the surface of the photosensitive body 10.

This electrostatic latent image is reversed and developed in a non-contact state by the developing unit 13 for Y. As the photosensitive body 10 rotates, a Y toner image is formed on the photosensitive body 10.

The Y toner image formed on the photosensitive body 10 is transferred onto the intermediate transfer belt 20 by the transfer unit 25 for Y.

After that, the photosensitive body 10 is cleaned by the cleaning unit 14, and is set in the next image formation cycle (this applies to the cleaning processes for M, C, and K, and a description thereof will thus be omitted).

Subsequently, the write unit 12 writes an image corresponding to a color signal M (magenta), i.e., M image data, and an electrostatic latent image corresponding to the M image of the document image is formed on the surface of the photosensitive body 10. This electrostatic latent image forms an M toner image on the photosensitive body 10 by the developing unit 13 for M. The M toner image is synchronized with the Y toner image on the intermediate transfer belt 20 by the transfer unit 25 for M, and is overlaid on it.

With the same process, a C (cyan) toner image is synchronized with the Y and M overlaid toner images, and is overlaid on them by the transfer unit 25 for C. Furthermore, a K (black) toner image is synchronized with the Y, M, and C overlaid toner images, and is overlaid on them by the transfer unit 25 for K. Thus, Y, M, C, and K overlaid toner images are formed on the intermediate transfer belt 20.

The intermediate transfer belt 20 carrying the overlaid toner images is sent clockwise as indicated by the arrow. The transfer medium P is sent from the corresponding paper cassette 72 by the corresponding paper feed roller 70, and is conveyed to the timing rollers 71 through the convey rollers 73. The transfer medium P is then synchronized with the overlaid toner images on the intermediate transfer belt 20 by the driving operation of the timing rollers 71, and is fed to a transfer region S of the transfer roller 26 (in contact with the intermediate transfer belt 20) to which a DC voltage having an opposite polarity to that of the toner is applied. Then, the overlaid toner images on the intermediate transfer belt 20 are transferred to the transfer medium P.

After that, the intermediate transfer belt 20 travels, and charges of the remaining toner are weakened by the discharging rollers 27. The intermediate transfer belt 20 is cleaned by the cleaning blade 29 which is in contact with it. Thus, the intermediate transfer belt 20 is set in the next image formation cycle.

The transfer medium P to which the overlaid toner images have been transferred is further sent to the fixing unit 4, and is clamped and conveyed by it while being applied with heat and pressure at the nip portion T between the heat roller 41 and press roller 42. The transfer medium P on which the overlaid toner images have been fused and fixed is conveyed to a delivery tray 82 by delivery rollers 81.

What is claimed is:

1. An image forming apparatus comprising a fixing unit which includes a heat section having a resilient body and a release layer that covers said resilient body, and a press section having a resilient body and a release layer that covers said resilient body and pressed by said heat section, and which heats and fixes a transfer medium at a nip portion as a press contact portion of said two sections, wherein at least one of the following three conditions is satisfied:

(a) a tensile strength of said resilient body of said heat section upon a lapse of an arbitrary use time is higher than an initial tensile strength thereof or is not lower than the initial tensile strength by not less than 0.5 MPa, (b) a relationship $(H1-H0)-(h1-h0)\leqq 0$ is always satisfied where H0 is the initial surface hardness of said heat section, h0 is the initial surface hardness of said press section, and H1 and h1 are the surface hardnesses of said heat section and said press section, respectively, upon a lapse of the arbitrary use time, and (c) a modulus of impact resilience of said resilient layer of said heat section upon a lapse of the arbitrary use time is higher than a modulus of initial impact resilience thereof before start of use, or is not lower than the modulus of initial impact resilience by not less than 10%.

2. An apparatus according to claim 1, wherein the initial tensile strength of said heat section is not less than 0.6 MPa.

3. An apparatus according to claim 1, wherein a temperature of said press section is set within such a temperature range that the tensile strength of said resilient body thereof does not decrease.

4. An apparatus according to claim 1, wherein SP<A and SP<B are always satisfied where SP is the surface pressure at said nip portion, A is the tensile strength of said resilient body of said heat section, and B is the tensile strength of said resilient body of said press section.

5. An apparatus according to claim 1, wherein a relationship between the initial surface hardness H0 of said heat section and the initial surface hardness h0 of said press section satisfies H0<h0.

6. An apparatus according to claim 1, wherein $40\% \leqq E0 \leqq 60\%$ is satisfied where E0 is the modulus of initial impact resilience of said resilient layer of said heat section.

7. An apparatus according to claim 1, wherein said resilient layer of said heat section uses such a member that the modulus of impact resilience thereof is always larger than that of said resilient layer of said press section.

8. An apparatus according to claim 1, wherein said heat section and said press section comprise a heat roller and press roller, respectively, and a diameter of said heat roller is larger than that of said press roller.

* * * * *